US006737795B2

(12) United States Patent
Huysmans et al.

(10) Patent No.: US 6,737,795 B2
(45) Date of Patent: May 18, 2004

(54) COLOR DISPLAY TUBE WITH IMPROVED COLOR SELECTION ELECTRODE

(75) Inventors: Ludovic Peter Willem Huysmans, Eindhoven (NL); Wilhelmus Marinus Maria Van De Steen, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/238,797

(22) Filed: Sep. 10, 2002

(65) Prior Publication Data

US 2003/0048062 A1 Mar. 13, 2003

(30) Foreign Application Priority Data

Sep. 13, 2001 (EP) ..... 01203464

(51) Int. Cl.[7] ..... H01J 29/80
(52) U.S. Cl. ..... 313/404; 313/402
(58) Field of Search ..... 313/402–408

(56) References Cited

U.S. PATENT DOCUMENTS 5,003,218 A 3/1991 Gijrath et al. ..... 313/406

FOREIGN PATENT DOCUMENTS

EP 0431693 A1 12/1991 ..... H01J/29/07

OTHER PUBLICATIONS

Patent Abstracts of Japan, Hasegawa Masami: "Color Picture Tube," Publication No. 63244545, Oct. 12, 1988, Application No. 62076046, Mar. 31, 1987.

*Primary Examiner*—Vip Patel
*Assistant Examiner*—Joseph Williams

(57) ABSTRACT

In color display tubes (1) the color purity performance is of the utmost importance. One of the factors adversely affecting this color purity performance is the microphony behavior of the shadow mask (13). Vibrations or shocks coming from outside the color display tube (1) can be transferred to the shadow mask (13) via the suspension means (20) of the color selection electrode (12). By introducing a vibration damping element (40, 45) coupled to the resilient element (30) of the suspension means (20), the amount of spot shift on the screen (6) due to these vibrations is reduced by at least 50%. The vibration damping element (40, 45) is preferably a flat plate which is rigidly coupled with one side to the suspension means (20), while the other side is in close contact with the resilient element (30), as a result of which it is capable of absorbing said vibrations.

8 Claims, 5 Drawing Sheets

COLOR DISPLAY TUBE WITH IMPROVED COLOR SELECTION ELECTRODE

BACKGROUND AND SUMMARY

This invention relates to a color display tube comprising a display window with a circumferential upright edge and corner areas, a color selection electrode comprising corner sections to which suspension means are coupled, which is suspended from supporting elements, secured to the corner areas.

The invention also relates to a color selection electrode for use in such a color display tube and to a corner section for use in such a color selection electrode.

A color display tube as described in the opening paragraph is disclosed in U.S. Pat. No. 5,003,218. The color display tube according to this specification is provided with a color selection electrode having a frame consisting of four diaphragm parts and four corner sections, suspended in the corners of the display window.

The color selection electrode serves to make sure that each electron beam coming from three electron guns mounted in a neck portion of the tube only excites the electroluminescent material of the appropriate color on the inner side of the display window. This color selection is achieved by applying, for instance, a shadow mask in the tube. This shadow mask comprises a pattern of apertures arranged in most cases in either a slotted pattern or a dotted pattern. If the color selection electrode is not stably positioned in the color display tube, small deviations from its position will lead to a deterioration of picture quality. If the color selection electrode is shifted slightly, for instance due to vibrations, the shadowing effect of the color selection electrode changes and consequentially, the electron beams do not hit the appropriate electroluminescent material on the display window. These misregistrations cause discoloration of the color display tube that lead to a deterioration of the quality of the picture.

Color display tubes with a color selection electrode as disclosed in U.S. Pat. No. 5,003,218 show in practice discolorations due to vibrations that are too large to fulfil the ever-increasing demand for picture quality. Especially wide screen tubes and tubes with a real flat or almost flat outer surface of the display window are affected by these problems. It is a disadvantage of the known color display tube that it shows misregistrations that are too large.

It is an object of the invention to provide a color display tube having a color selection electrode with an improved behavior with respect to color purity that overcomes the disadvantages of the prior art color display tube.

According to the present invention, this object is realized by means of a color display tube which is characterized in that a vibration damping element is coupled to the suspension means.

The invention is based on the insight that the color purity of the color picture tube is improved when vibrations which come from outside the color display tube cannot reach the shadow mask. These vibrations may be caused by, for instance, loudspeakers that are mounted in the cabinet or by other shocks exerted on the color display tube. The transfer of vibrations from the outside to the color selection electrode takes place via the suspension means of the color selection electrode in the display window. The general idea is to provide the suspension means with an element for damping the vibrations of especially those frequencies—the resonance frequencies—to which the color selection electrode is most sensitive. In this way the incoming vibrations will not be able to reach the color selection electrode and the color purity performance of the color display tube is improved.

In a preferred embodiment, the suspension means further comprise a resilient element, the vibration damping element being coupled to the resilient element.

In order to have a good suspension of the shadow mask in the display window, the suspension means are provided with a resilient element. The spring forces between the resilient elements and the supporting elements make sure that the shadow mask stays in the proper position in the color display tube. Vibrations coming from the outside can only be transferred to the shadow mask if they can pass these resilient elements. So, the best way to suppress these vibrations is by arranging the vibration damping element so as to be in contact with the resilient element in such a way that if the resilient element starts vibrating, this vibration energy is transferred to the vibration damping element and the amplitude of the vibration is extinguished.

In a further embodiment, the vibration damping element is positioned on the side of the suspension means facing the supporting element. Furthermore, it is plate-shaped having a first edge for rigidly coupling it to the resilient element and a second edge which is in contact with the resilient element and it is provided with a bend line extending substantially parallel to the first edge and the second edge and positioned between them.

This embodiment provides an advantageous way of constructing a vibration damping member. A plate-shaped element can be arranged parallel to the resilient element in such a way that a rigid connection is obtained at one side of the plate shaped element, while the other side is in free contact—due to the spring force—with the resilient element. The direction in which the resilient element is pushed when the color electrode is in its position in the color display tube makes it necessary to provide the vibration damping member with a bend in order to make sure that the side that is in free contact stays in contact.

Alternatively, in another embodiment the suspension means further comprise a rigid portion, and the vibration damping element is plate-shaped and positioned in between the rigid portion and the resilient element.

Here, the vibration element is positioned on the other side of the resilient element. Seen in the direction of the spring forces in the resilient element, a bend line in the vibration damping element is not required here.

The invention further relates to a color selection electrode for use in such a color display tube and to a corner section for use in such a color selection electrode.

BRIEF DESCRIPTION OF THE DRAWINGS

These and other aspects of the invention will be apparent from and elucidated by way of non-limitative examples with reference to the drawings and embodiments described hereinafter.

In the drawings.

DETAILED DESCRIPTION

Figure 1:
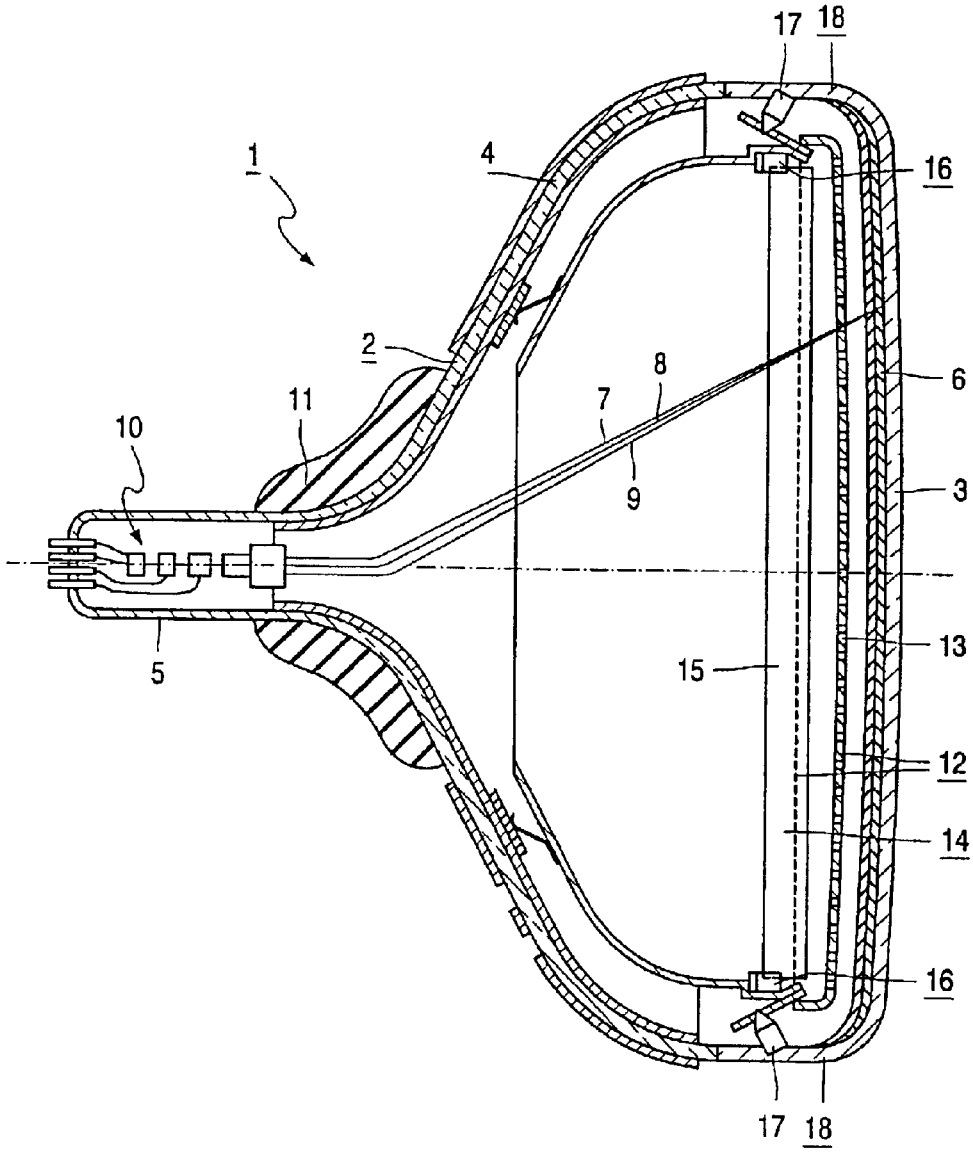
FIG. 1 is a sectional view of a color display tube according to the invention.

The color display tube 1 shown in FIG. 1 comprises an evacuated glass envelope 2 with a display window 3, a funnel-shaped part 4 and a neck 5. On the inner side of the display window 3 a screen 6 having a pattern of for example lines or dots of phosphors luminescing in different colors (e.g. red, green and blue) may be arranged. The phosphor pattern is excited by the three electron beams 7, 8 and 9 that are generated by the electron gun 10. On their way to the screen the electron beams 7, 8 and 9 are deflected by the deflection unit 11, ensuring that the electron beams 7, 8 and 9 systematically scan the screen 6. Before the electrons hit the screen 6 they pass through a color selection electrode 12. This color selection electrode 12 comprises a shadow mask 13, which is the real color selective part: it intersects the electron beams so that the electrons only hit the phosphor of the appropriate color. The shadow mask 13 may be an apertured mask having circular or elongate apertures, or a wire mask. Furthermore, the color selection electrode 12 comprises the frame 14 for supporting the shadow mask 13. Parts that can be distinguished in the frame 14 are, amongst others, the corner sections 16 and the diaphragm parts 15 interconnecting the corner sections 16.

The color selection electrode 12 is suspended from the display window 3 by using supporting elements 17, which are secured in the upright edge of the corner areas 18 of the display window 3. This way of suspending the color selection electrode 12 in a color display tube 1 will hereinafter be referred to as corner suspension.

Figure 2:
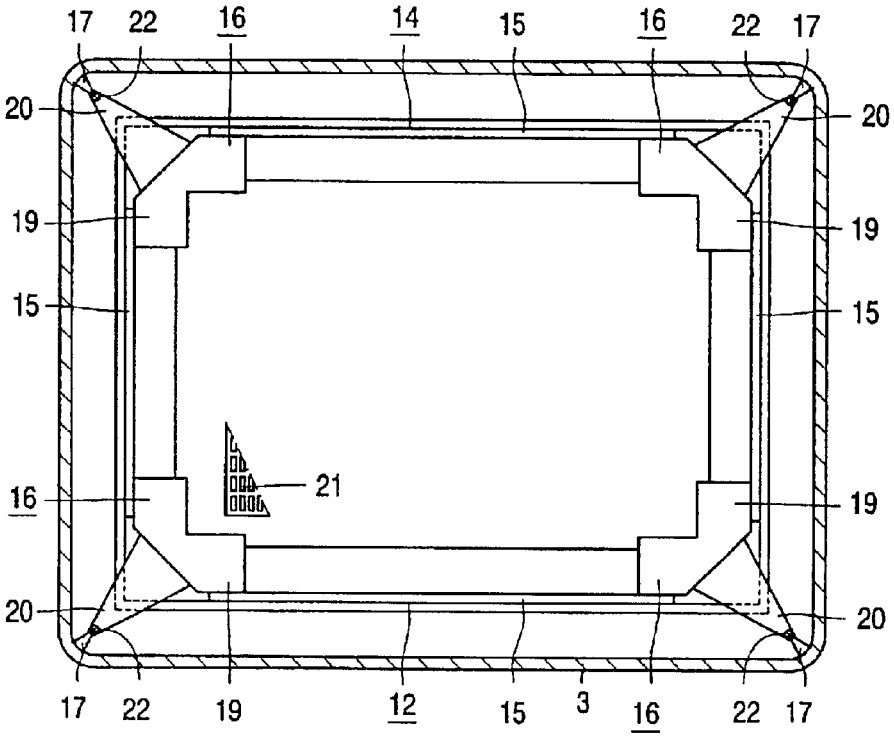
FIG. 2 is an elevational view of a color selection electrode mounted in a display window.

In FIG. 2 an elevational view of a color selection electrode 12 mounted in a display window 3 is shown. The corner sections 16 in this Figure comprise two major portions, a rigid portion 19 for coupling the diaphragm parts 15 and a suspension means 20 for suspending the color selection electrode 12 from the display window 3. The shadow mask 13, section 21 of which only serves as an example, is coupled to the diaphragm parts 15. Furthermore, the supporting elements 17 are provided with a free end portion 22 for engaging the suspension means 20.

Figure 3:
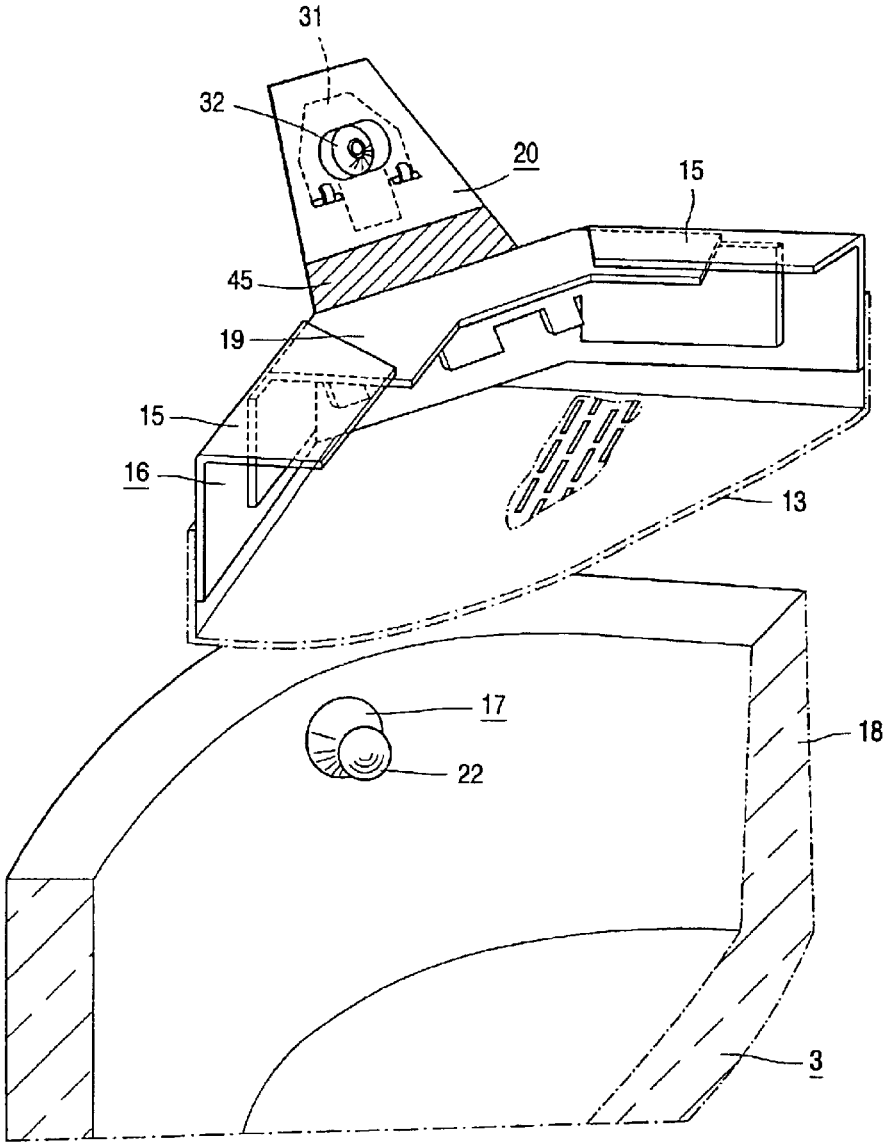
FIG. 3 is a perspective view of the corner area of the display window and the corner section of the color selection electrode.

An enlarged view of a corner section 16 and the corner area 18 of the display window 3 with the supporting element 17 is given in FIG. 3. To accurately position the color selection electrode 12, the suspension means 20 comprises a resilient element 30 and may further be provided with a slide plate 31 containing a conical section 32 for engaging the free end portion 22 of the supporting element 17. In a completed color display tube 1, the color selection electrode 12 is suspended from the supporting elements 17 by means of the suspension means 20. This suspension means 20, or in fact the resilient element 30—which is part of the suspension means 20—forms the connection between the display window 3 and the shadow mask 13.

In present-day color display tubes 1, external shocks or vibrations are transferred to the shadow mask 13. This leads to vibrations—also referred to as microphony—of the shadow mask 13. If the microphony performance of a color display tube 1 is not well-designed, shocks or vibrations will be transferred to the shadow mask 13 that will start vibrating as well. As a consequence, the shadow mask 13 will be subject to positional instabilities, leading to an adversely affected landing performance. This means that part of the electrons will not impinge on phosphors of the appropriate color on the screen 6; instead they will impinge on, for instance, the black matrix structure or on an adjacent (wrong color) phosphor. The result is a decrease of the color purity performance of the color display tube 1.

This problem is solved by the present invention. When external shocks and vibrations are passed on to the shadow mask 13, this can start vibrating in its resonance frequencies. This situation may occur when the shocks and vibrations can pass the resilient element 30 of the suspension means 20. If vibrations are damped in this suspension means 20, the microphony problem of the shadow mask 13—insofar as it is related to passage of this kind of vibrations through the resilient element 30—is solved. According to the invention this is realized by providing the suspension means 20 with a vibration damping element 40.

In FIG. 3, the vibration damping element 45 has been fixed to the resilient element 30. In this case it is positioned on the side pointing towards the rigid portion 19 indicated by the shaded area.

Figure 4:
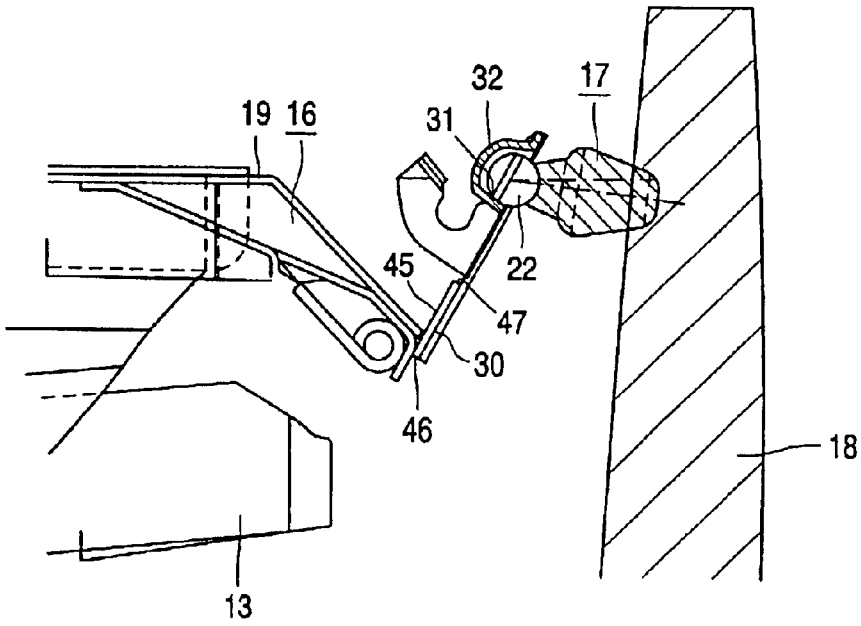
FIG. 4 is a cross section of an embodiment of a corner section of the color selection electrode according to the invention.

A cross section of this embodiment is given in FIG. 4. In said Figure the vibration damping element 45 is positioned between the rigid portion 19 and the resilient element 30. The edge 46 of the vibration damping element 45 is rigidly connected to either the rigid portion 19 or the resilient element 30. This connection can be formed by, for instance, welding. Evidently, an additional connection is present for coupling the resilient element 30 to the rigid portion 19. Alternatively, the vibration damping element 45 may be sandwiched between the rigid portion 19 and the resilient element 30 and connected to these other two parts.

The edge 47 at the opposite side of the vibration damping element 45 is positioned in such a way that it is in close contact with the resilient element 30, but it is not attached to it. When a shock or vibration from outside the color display tube 1 is transferred to the suspension means 20, the resilient element 30 starts vibrating. This vibration energy can be absorbed by the vibration damping member 45 because its edge 47, being in contact with the resilient element 30, limits the amplitude of the vibration in the resilient element. In this way, the vibration is damped and cannot, or only to a substantially lower level, be transferred to the shadow mask 13. Consequentially, the positional accuracy of the shadow mask 13 is improved, leading to a better color purity of the color display tube 1, which is one of the major criteria for picture quality.

Figure 5:
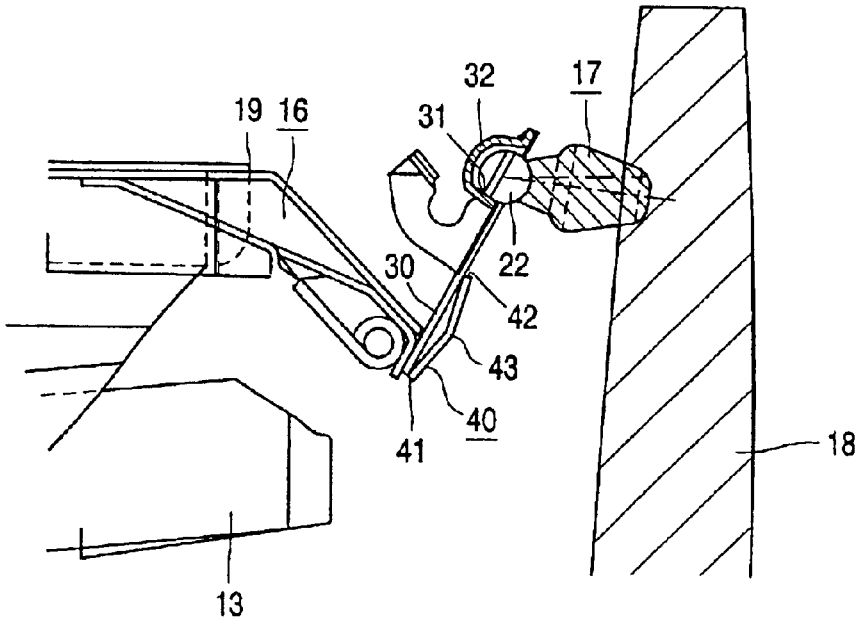
FIG. 5 is a cross section of another embodiment of a corner section of the color selection electrode according to the invention.

The vibration damping element 40 can also be positioned on the side of the resilient element 30 pointing in the direction of the supporting element 17, in which case the vibration damping element 40 cannot be seen in FIG. 3, because it is at the back of the resilient element 30. The cross section of FIG. 5 shows the construction for a vibration damping element 40 positioned on said side of the resilient element, which is similar to the vibration damping element 45 as shown in FIG. 4.

The edge 41 of the vibration damping element 40 is rigidly—for instance by welding—connected to the resilient element 30, while the other edge 42 is in close contact with the resilient element 30. A vibration damping element 40 on the side of the supporting element 17 is preferably provided with a bend 43. This bend 43 may be parallel to the edges 41 and 42. Due to the construction of the suspension means 20, when the color selection electrode 12 is placed in the display window 3 a force is exerted on the resilient elements 30 in a direction away from the vibration damping element

40. This may lead to a situation where the edge 42 loses contact with the resilient element 30, nullifying the action of the vibration damping element 40. The bend 43 ensures that the edge 42 stays in contact with the resilient element 30, while the intermediate part of the vibration damping element, between the edge 41 and 42, stays clear of the resilient element 30.

It is a matter of skill to design the dimensions and mass of the vibration damping element 40, 45 in such a way that the resonance frequencies of the shadow mask 13 are most effectively suppressed.

Figure 6:
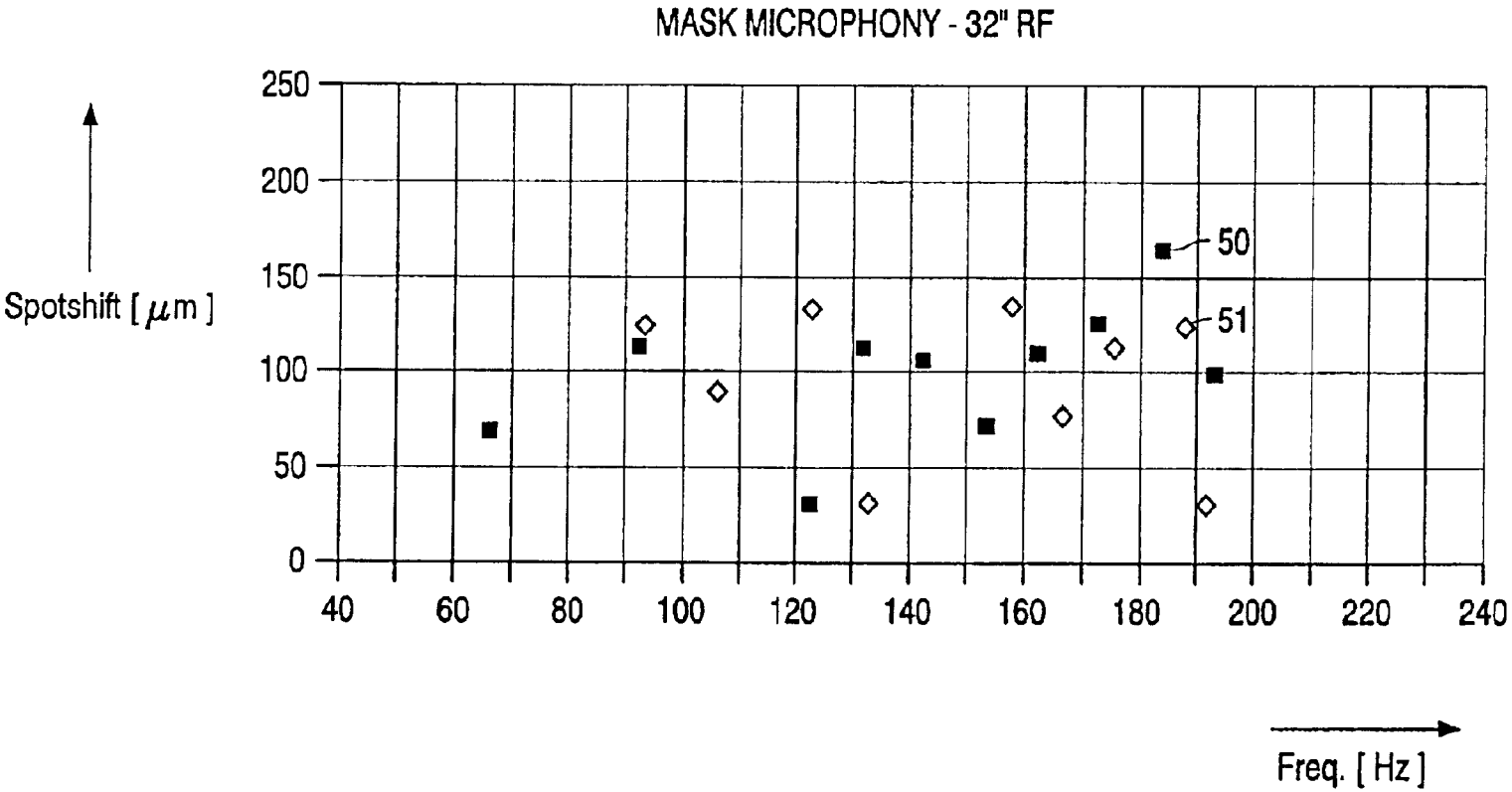
FIG. 6 is a graph with microphony measurements carried out on a color display tube according to the invention.

By way of example, FIG. 6 gives measurements carried out on an engineering sample of a 32 inch real flat wide-screen cathode ray tube provided with vibration damping elements 40, 45 according to the invention. This Figure shows the maximum displacement on the screen 6 of the electron spots projected through the apertures in the shadow mask 13 as a function of the frequency of the outside vibration. On an average this displacement is about 100 $\mu$m for the vibration damping element 40,45 on the side of the supporting element 17, indicated by the black squares 50, as well as for the vibration damping element 40, 45 on the side of the rigid portion 19, as indicated by the white diamonds 51.

In a prior art color display tube 1 of the same size, these displacements are approximately 250 $\mu$m. So, the present invention gives a reduction of the displacement of the electron spots on the screen 6, due to external vibrations that are transferred to the shadow mask 13, of about 60%.

Summarizing, in color display tubes 1 the color purity performance is of the utmost importance. One of the factors adversely affecting this color purity performance is the microphony behavior of the shadow mask 13. Vibrations or shocks coming from outside the color display tube 1 can be transferred to the shadow mask 13 via the suspension means 20 of the color selection electrode 12. By introducing a vibration damping element (40, 45) coupled to the resilient element 30 of the suspension means 20, the amount of spot shift on the screen 6 due to these vibrations is reduced by at least 50%. The vibration damping element 40, 45 is preferably a flat plate which is rigidly coupled with one side to the suspension means 20, while the other side is in close contact with the resilient element 30, as a result of which it is capable of absorbing said vibrations.

What is claimed is:

1. A color display tube comprising a display window with a circumferential upright edge and corner areas, a color selection electrode comprising corner sections to which suspension means are coupled, which is suspended by a resilient element from supporting elements, secured to the corner areas, and a vibration damping element having a first edge rigidly coupled to the suspension means and to the resilient element and a second edge for contacting the resilient element.

2. A color display tube as claimed in claim 1, wherein the vibration damping element is positioned on the side of the suspension means facing the supporting element.

3. A color display tube as claimed in claim 2, wherein the vibration damping element is plate shaped.

4. A color display tube as claimed in claim 3, wherein the vibration damping element is provided with a bend line extending substantially parallel to the first edge and the second edge and positioned between them.

5. A color display tube as claimed in claim 1, wherein the suspension means further comprise a rigid portion, and the vibration damping element is plate-shaped and positioned between the rigid portion and the resilient element.

6. A color display tube as claimed in claim 5, wherein the vibration damping element has a first edge for rigidly coupling it to the resilient element and to the rigid portion, and a second edge which is in contact with the resillent element.

7. A color selection electrode for use in a color display tube as claimed in claim 1.

8. A corner section for use in the color selection electrode as claimed in claim 7.

* * * * *